US010746472B2

(12) United States Patent
Zheng et al.

(10) Patent No.: US 10,746,472 B2
(45) Date of Patent: Aug. 18, 2020

(54) SPIRAL FINNED CONDENSER

(71) Applicant: CHANGZHOU CHANGZHENG HECHANGER TECHNOLOGY CO., LTD., Changzhou (CN)

(72) Inventors: Lei Zheng, Changzhou (CN); Jianyuan Chen, Changzhou (CN)

( * ) Notice: Subject to any disclaimer, the term of this patent is extended or adjusted under 35 U.S.C. 154(b) by 79 days.

(21) Appl. No.: 16/133,700

(22) Filed: Sep. 18, 2018

(65) Prior Publication Data

US 2019/0017746 A1 Jan. 17, 2019

Related U.S. Application Data

(63) Continuation of application No. PCT/CN2016/095982, filed on Aug. 19, 2016.

(51) Int. Cl.

| | |
|---|---|
| ***F28D 1/047*** | (2006.01) |
| ***F28F 1/36*** | (2006.01) |
| ***F25B 39/04*** | (2006.01) |
| ***F28F 9/013*** | (2006.01) |
| ***F28F 19/00*** | (2006.01) |
| ***F28D 21/00*** | (2006.01) |

(52) U.S. Cl.

CPC ..... *F28D 1/0472* (2013.01); *F25B 39/04* (2013.01); *F28F 1/36* (2013.01); *F28F 9/0132* (2013.01); *F28F 19/002* (2013.01); *F28D 2021/0063* (2013.01); *F28F 9/0138* (2013.01)

(58) Field of Classification Search

CPC ..... F28F 9/0138; F28F 9/0132; F28F 1/36; F28D 1/0472

USPC ..... 165/69

See application file for complete search history.

(56) References Cited

U.S. PATENT DOCUMENTS

| | | | | |
|---|---|---|---|---|
| 3,083,447 A * | 4/1963 | Andersen | F28F 9/0132 29/890.037 |
| 4,244,542 A * | 1/1981 | Mathews | F16L 3/222 138/112 |
| 4,492,269 A * | 1/1985 | Jennings | F25B 39/02 165/125 |
| 8,033,323 B2 * | 10/2011 | Schatz | F28F 9/013 165/69 |
| 2001/0040021 A1 * | 11/2001 | Avequin | F28F 9/002 165/67 |
| 2002/0148116 A1 * | 10/2002 | Rhodes | F24S 80/30 29/890.043 |

(Continued)

FOREIGN PATENT DOCUMENTS

| | | |
|---|---|---|
| CN | 104165480 A | 11/2014 |
| CN | 104315760 A * | 1/2015 |

(Continued)

OTHER PUBLICATIONS

Translation of CN 104315760 A entitled Translation—CN 104315760 A (Year: 2020).*

(Continued)

*Primary Examiner* — Paul Alvare

(74) *Attorney, Agent, or Firm* — Erson IP (Nelson IP)

(57) ABSTRACT

Provided is a spiral finned condenser. The spiral finned condenser includes a condensing pipe and a fin. The fin is spirally wound on a surface of the condensing pipe. The condensing pipe forms a cubie structure by a plurality of turns and bends. The condenser further includes a fixing bracket which is clamped and fixed on the condensing pipe.

4 Claims, 8 Drawing Sheets

(56) References Cited

U.S. PATENT DOCUMENTS

| | | | | |
|---|---|---|---|---|
| 2007/0051506 | A1* | 3/2007 | Lee | F25B 39/04 165/184 |
| 2010/0276131 | A1* | 11/2010 | Barwig | F02B 29/0462 165/162 |
| 2015/0021004 | A1* | 1/2015 | Mui | F28D 21/0003 165/158 |
| 2016/0146476 | A1* | 5/2016 | Morikawa | F28D 1/0426 165/157 |

FOREIGN PATENT DOCUMENTS

| | | | |
|---|---|---|---|
| CN | 104315760 | A | 1/2015 |
| CN | 204176970 | U | 2/2015 |
| CN | 106196757 | A | 12/2016 |
| JP | 2002005558 | A | 1/2002 |
| KR | 101223423 | B1 * | 2/2013 |
| KR | 101223423 | B1 | 2/2013 |

OTHER PUBLICATIONS

Translation of KR 101223423 B1 entitled Translation—KR 101223423 B1 (Year: 2020).*

Internation Search Report of PCT/CN2016/095982, dated May 9, 2017.

* cited by examiner

SPIRAL FINNED CONDENSER

CROSS-REFERENCE TO RELATED APPLICATIONS

This application is a continuation of International Patent Application No. PCT/CN2016/095982 with a filing date of Aug. 19, 2016, designating the United States, now pending. The content of the aforementioned application, including any intervening amendments thereto, is incorporated herein by reference.

TECHNICAL FIELD

The disclosure relates to the technical field of condersers, and particularly to a spiral firmed condenser.

BACKGROUND OF THE PRESENT INVENTION

Generally, the condensers in prior art are water condensers, vertical mixing pipe bundle condensers, wire tube condensers and the like. These condensers are usually large in dissipation area so as to enhance the cooling effect. However, it leads to problems like larger volume and higher costs, and the application of these condensers are hence greatly limited. Once a small condenser is adopted, the dissipation performance will degrade.

A Chinese invention patent. No. 200610111866.5 provides a spiral finned condenser comprising a spiral finned pipe 15, a Vertical fixing component 30 and a horizontal fixing component 20. The spiral firmed pipe 15 is firstly bent into a serpentine shape so as to be horizontally arranged and fixed by the horizontal fixing mechanism 20, and then the second vertical bend is performed based on the serpentine shape and is arranged and fixed vertically by the vertical fixing mechanism 30. The horizontal fixing mechanism 20 comprises a fixing device 28 which comprises a semiterete portion and an ex-tension portion 26. The inner diameter of the semiterete portion is equal to the outer diameter of the spiral finned pipe 15, and the extension portion 26 extends in parallel on two sides of the semiterete portion. The invention solves the defects existing in the prior art, however, some hidden dangers are still exist in this structure. The horizontal fixing component is clamped on the spiral fin directly, which causes serious damage to the fins when clamping and fixing, thereby leading to inefficiency in condensing.

SUMMARY OF PRESENT INVENTION

Aiming at above technical problems, the disclosure provides a spiral finned condenser.

The disclosure is realized by the following technical solutions:

A spiral finned condenser comprises: a condensing pipe, a fin and a fixing bracket clamped and fixed on the condensing pipe; the fin is spirally wound on a surface of the condensing pipe; the condensing pipe forms a cubic structure by means of a plurality of turns and bends.

Advantageously, an inner side of the fin is connected to the condensing pipe and is in a wavy structure, and an outer side of the fin is in a smooth structure.

Advantageously, the fixing bracket comprises a mounting plate and a clamping mechanism provided to a side wall of the mounting plate; the clamping mechanism consists of a plurality of clamping units distributed evenly on the mounting plate with regular intervals between neighboring units; each clamping unit consists of two clamping sheets, and a clamping slot fit to the condensing pipe is defined between two adjacent clamping sheets.

Advantageously, a bottom of the clamping slot is provided with at least one adjusting groove which extends to the mounting plate.

Advantageously, a number of the clamping mechanism is one or two.

Advantageously, the fixing bracket comprises a mounting plate and a plurality of clamping sheets alternately arranged on two sides of the mounting plate; a T-shaped structure is formed after the two sides of the mounting plate are bended twice; and a clamping slot fit to the condensing pipe is formed between the two clamping sheets.

Advantageously, an angle of a first bending is 180° and an angle of a second bending is 90°.

Advantageously, a plane in which the clamping sheets locate is under a plane in which the mounting plate locates.

Advantageously, an inner inclined surface is defined on an inner side of an end portion of the clamping sheet, an outer inclined surface is defined on an outer side of the end portion, and a flat or curved surface is arranged between the inner and outer inclined surfaces.

Advantageously, a gradient of the outer inclined surface is greater than that of the inner inclined surface.

Adopting the above proposals, the condenser according to the disclosure is in a cubic structure with a shape of a Chinese character "custom-character". The volume is reduced, the structure is compact and firm, and the cost is lowered. There are sufficient ventilation and heat dissipation spaces inside the structure to ensure the effects of heat exchanging and hence improve the efficiency and capacity of cooling. In one aspect, the fixing bracket fixes the condenser pipes to ensure the fixed intervals between pipes and avoid deformation of the condenser under pressure; in another aspect, the fixing bracket prevents fins from deforming or entangling and avoids producing negative effects on cooling.

Instead of clamping and fixing on the fins, the fixing bracket in the disclosure changes the previous way for fixing and is clamped and fixed on the surface of the condensing pipes directly for achieving the purpose of fixing the condensing pipes. This way for fixing is reliable and stable without damaging the fins directly or indirectly. The function of fins is to increasing the exchanging area and efficiency of heat transferring. Once fins are deformed or entangled, the cooling effect of the condenser will be greatly reduced, resulting in poor local heat exchange effect, disordered airflow, thereby the heat cannot be dissipated, and the condenser may even stop working in serious cases. In the disclosure, even if the condenser is extruded under external forces, the external forces will only act on the fixing bracket and condensing pipes, most of which act on the fixing bracket, so as to protect the structure and shape of fins and, avoid deformation of condensing pipes, and hence ensure cooling effect.

DETAILED DESCRIPTION OF PREFERRED EMBODIMENTS

The present disclosure is further described below in detail with reference to embodiments and accompanying drawings.

Embodiment 1

Referring to FIG. 1 to FIG. 6, a spiral finned condenser comprises: a condensing pipe 1 and a fin 2. The fin 2 is spirally wound on a surface of the condensing pipe 1. An inner side of the fin 2 is connected to the condensing pipe 1 and is in a wavy structure 21, and an outer side of the fin is in a smooth structure 22. One reason for wavy structure connection is firm connection, avoiding sliding, dispersing the force when assembling and protecting structure from damaging; another reason is guiding the heat and airflow to accelerate dissipation. The smooth structure at the outer side of the fin ensures that the heat dissipation direction of the fins during dissipation is uniform linear heat dissipation. If the outer side of the fin is still in the wavy structure, the dissipation will be in nonlinear, and the heat radiation will have crossover and overlap. When the heat radiation waves overlap, they will affect each other, causing a certain resistance, which affects the cooling effect.

Condensing pipes form a cubic structure by means of a plurality of turns and bends, which reduces greatly the volume of the condenser and the space occupied, at the same time ensures the cooling effect, thereby have abroad application.

Figure 1:
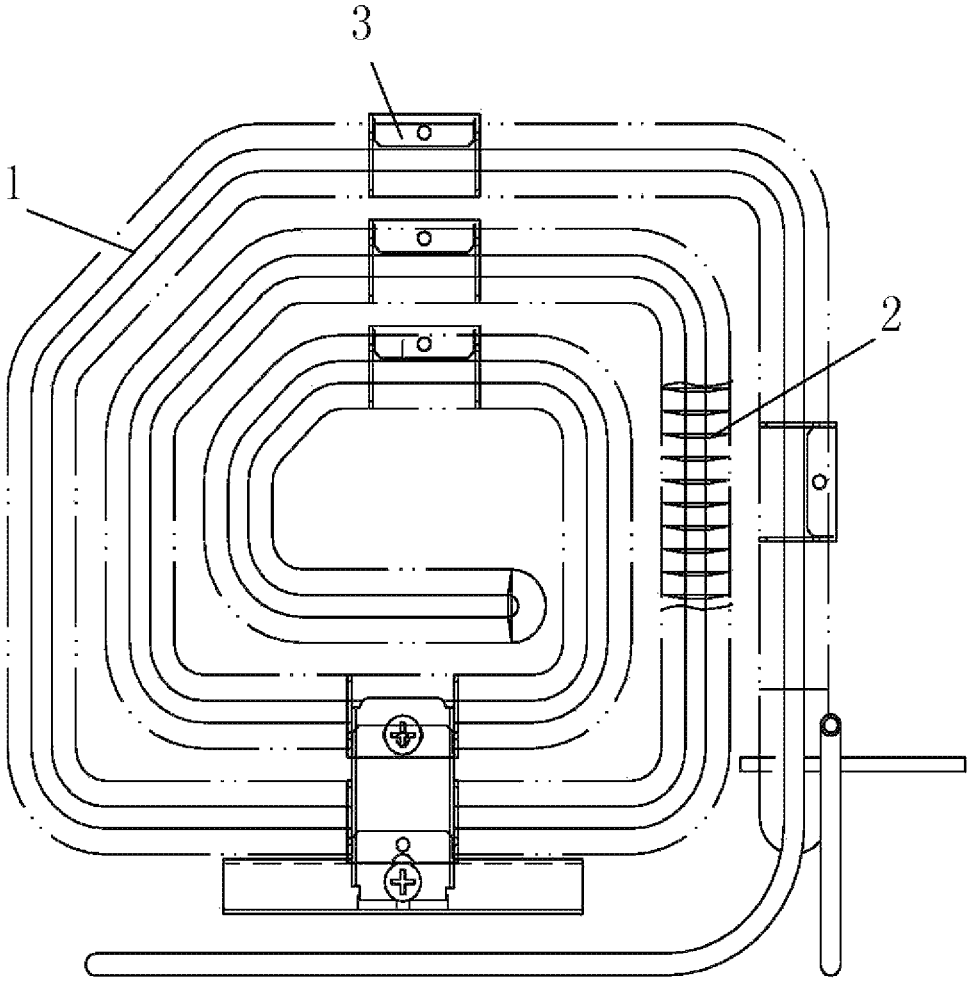
FIG. 1 is a structural diagram of a spiral finned condenser according to the present disclosure.
Figure 2:
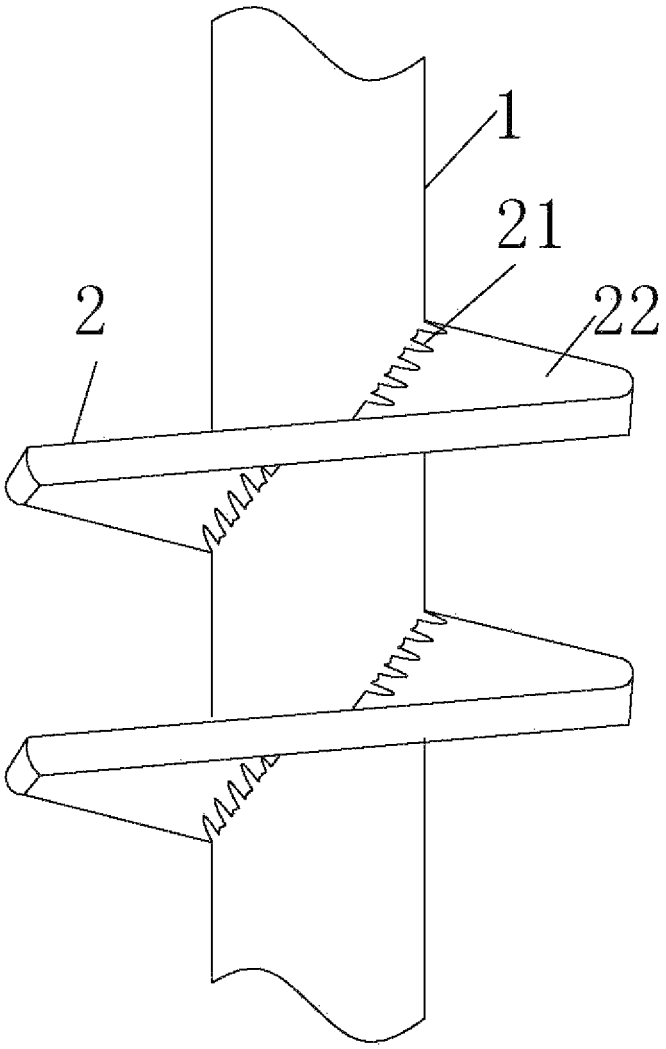
FIG. 2 is a schematic diagram showing a connection between a condensing pipe and a fin.
Figure 3:
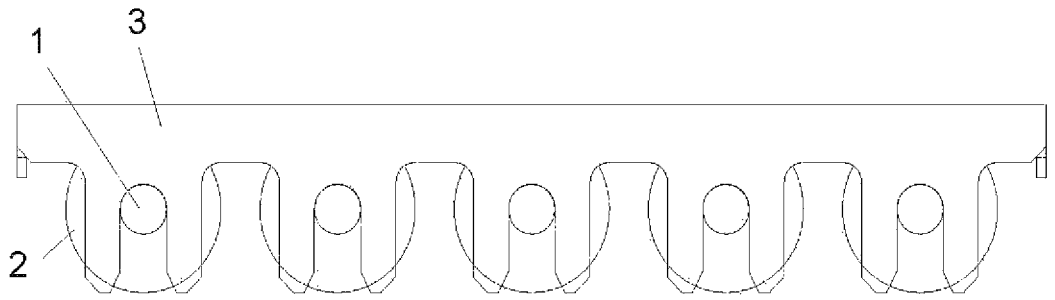
FIG. 3 is a schematic diagram showing a connection between a fixing bracket and a condenser.
Figure 4:
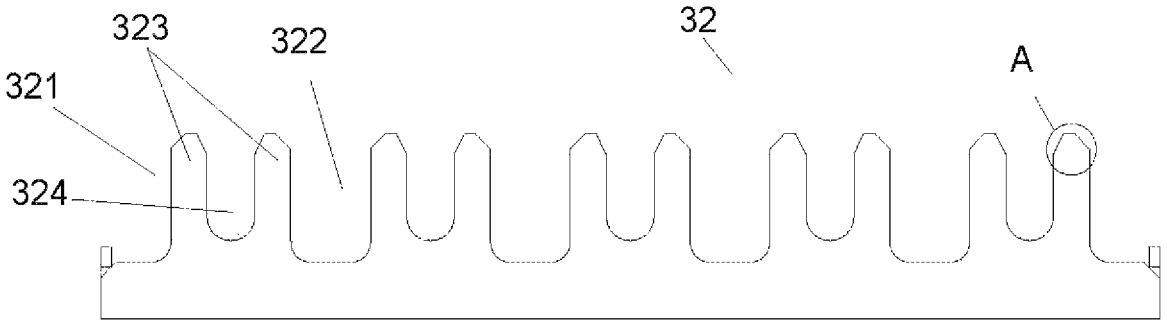
FIG. 4 is a structural diagram of the fixing bracket.
Figure 5:
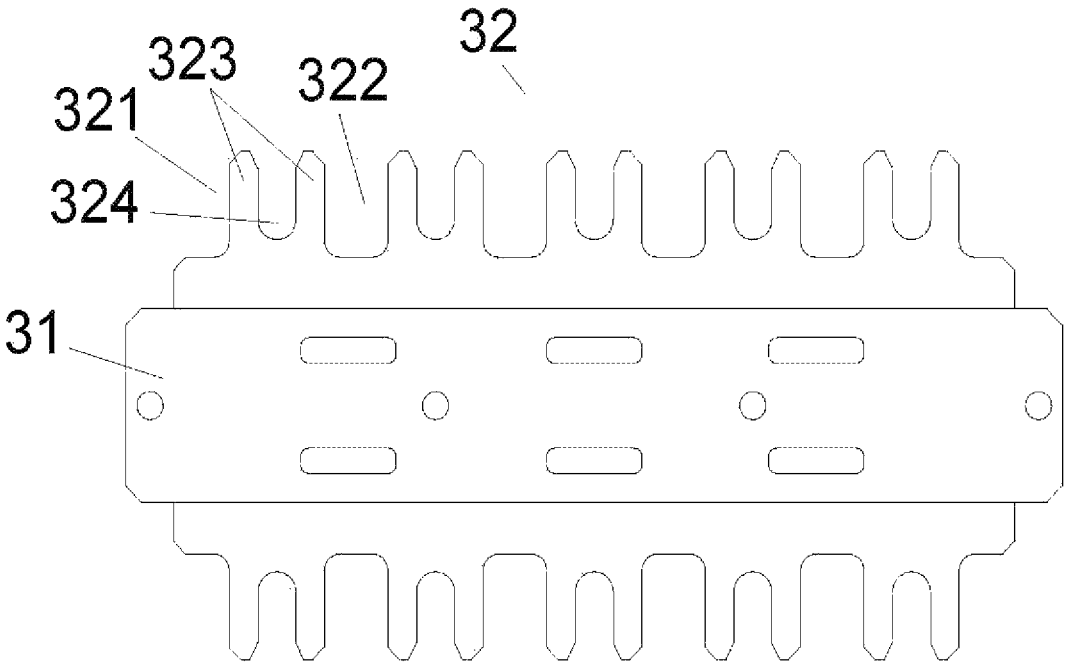
FIG. 5 is a first unfold structural diagram of the fixing bracket.
Figure 6:
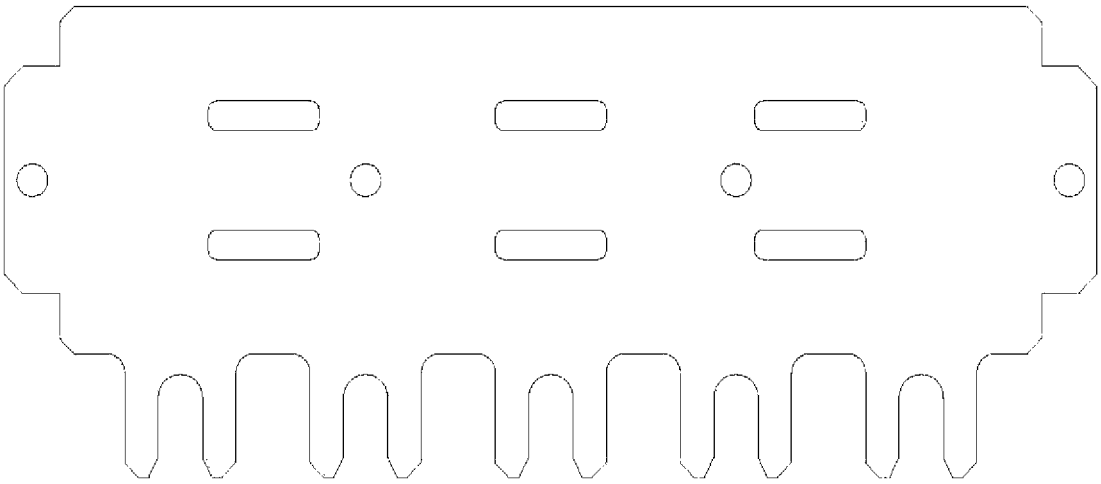
FIG. 6 is a second unfold structural diagram of the fixing bracket.

The spiral finned condenser further comprises a fixing bracket 3, which is fit the fins 2, and is clamped and fixed on the condensing pipe 1. The fixing bracket 3 includes a mounting plate 31 and a clamping, mechanism 32 provided to a side wall of the mounting plate 31 vertically. The number of the clamping mechanism can be one (FIG. 6) or two (FIG. 5). When there is one clamping mechanism, it may be arranged on any side of the mounting plate. When there are two clamping mechanisms, they should be even distributed on the two sides of the mounting plate. The adjusting of the clamping mechanism depends on the structure and size of the condenser. Usually, the mounting plate and the clamping mechanism are integrally formed and later formation is finished by means of machining or manual processing for convenience.

The clamping mechanism 32 consists of a plurality of clamping units 321 uniformly distributed on the mounting plate 31 with regular intervals 322 between neighboring units, and the width of intervals is equal to that between condensing pipes. Each clamping unit 321 consists of two clamping sheets 323, and a clamping slot 324 fit to the condensing pipe is defined between the two clamping sheets. Align the clamping slot with the condensing pipe and insert it into a bottom when the fixing bracket is mounted on the condensing pipe. Generally, the length of the clamping sheet is relatively longer, which is at least twice as long as the outer diameter of the condensing pipe. When the condensing pipe is stuck in the clamping slot, the mold is used to press the clamping sheet laterally. Namely, the distance between the ends of the two clamping sheets is contracted to fix the condensing pipe firmly.

Embodiment 2

Figure 7:
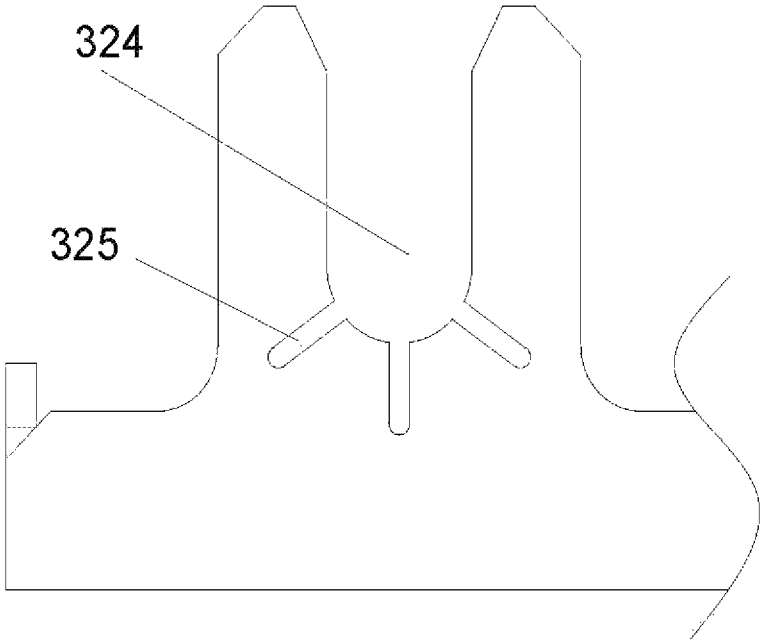
FIG. 7 is another structural diagram of the fixing bracket.
Figure 8:
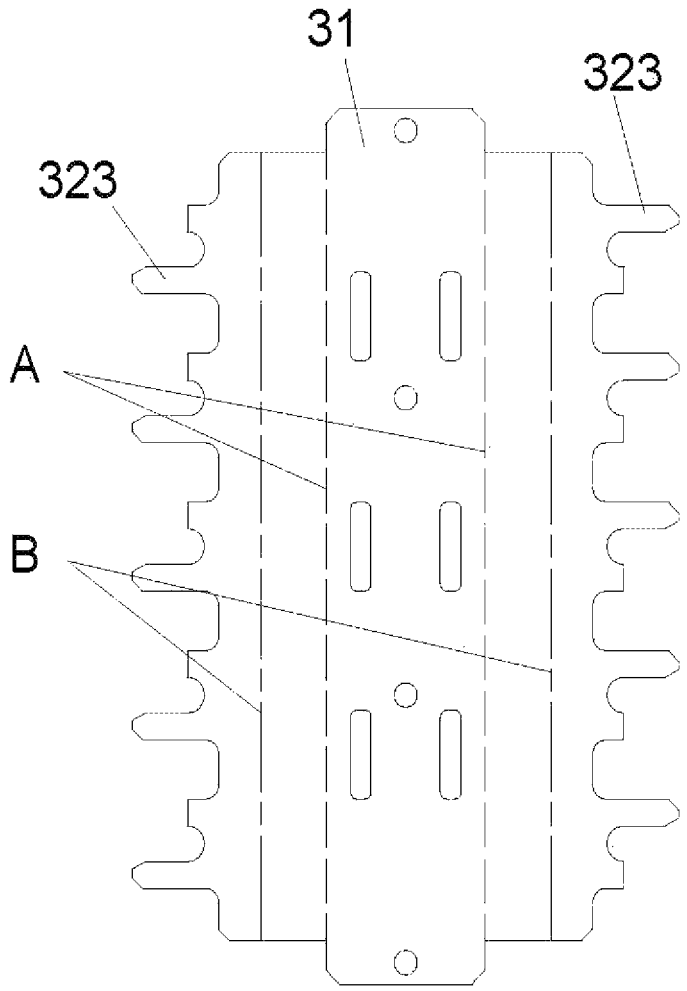
FIG. 8 is another unfold structural diagram of the fixing bracket.
Figure 9:
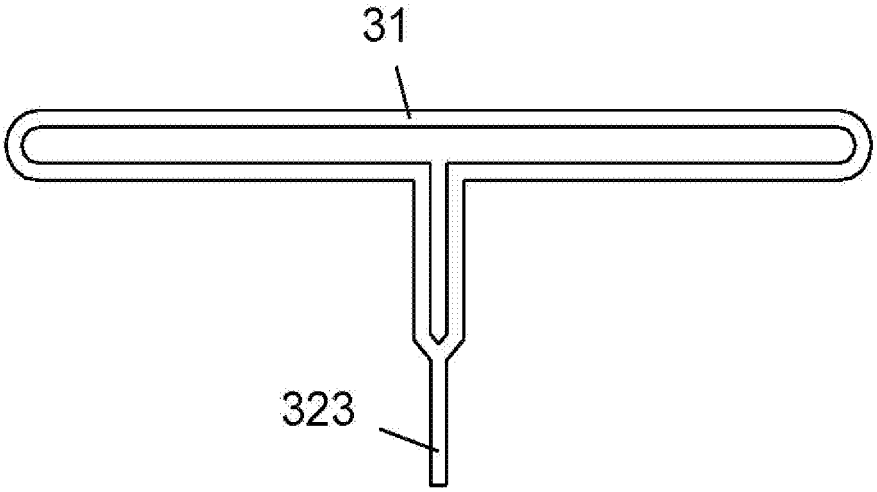
FIG. 9 is a structural diagram based, on FIG. 8.
Figure 10:
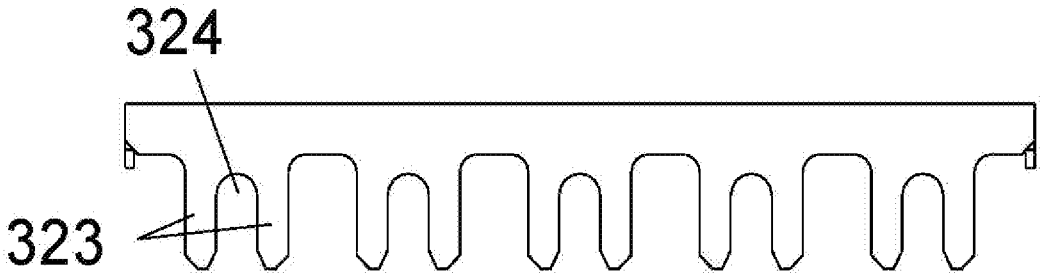
FIG. 10 is a left side view of FIG. 9.
Figure 11:
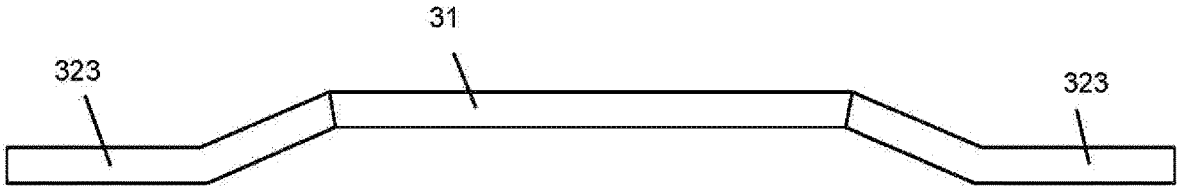
FIG. 11 is a bottom plan view of FIG. 8.

Referring to FIG. 7, the clamping sheet is in a rigid structure, and for preventing the clamping sheet from breaking and for contracting the clamping sheet smoothly, three adjusting groove 325 are provided at a bottom of the clamping slot 324, and the adjusting grooves extend to the mounting plate.

Embodiment 3

Referring to FIG. 8 to FIG. 11, the fixing bracket 3 comprises the mounting plate 31 and a plurality of clamping sheets 323 alternately arranged on the two sides of the mounting plate 31. A T-shaped structure is formed after the two sides of the mounting plate are bended twice. Generally speaking, an angle of a first bending at a position A is 180° and an angle of a second bending at a position B is 90°, and the sequence of bending can be reversed. A clamping slot 324 fit to the condensing pipe is formed between the two clamping sheets 323. The end of the mounting plate becomes a limiting part, keeping the condensing pipe being in clamping slot. A plane in which the clamping sheet locates is under a plane in which the mounting plate locates, so as to ensure all the clamping sheets are on the same plane and clamp the condensing pipe availably. Meanwhile the mounting plate can cover more fins and prevent the fins from being deformed when the fixing bracket or the condenser is installed.

Figure 12:
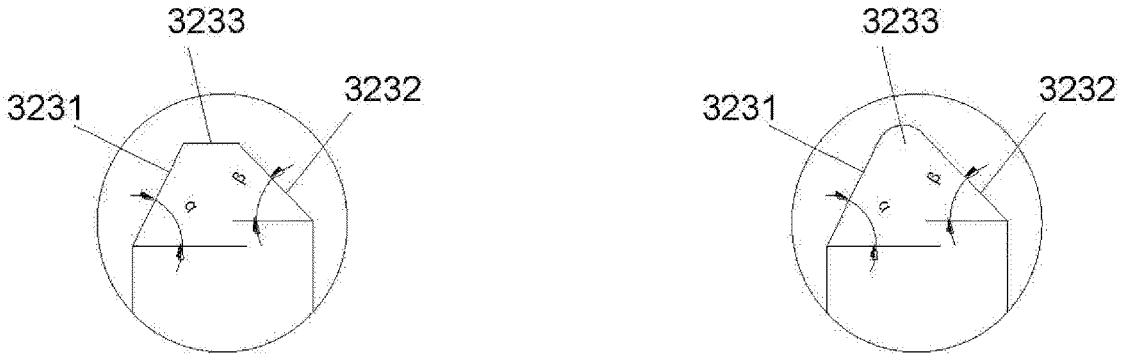
FIG. 12 is an enlarged view of portion A in FIG. 4.

Referring to FIG. 12, an inner inclined surface 3231 is defined at an inner side of an end portion of the clamping sheet 323 to form a bigger end caliber of the clamping slot, so it is easier for the condensing pipe to align and be, inserted into the clamping slot, and prevent the condensing pipe from bending before inserted into the slot. An outer inclined surface 3232 is defined on an outer side of the end portion to remove the sharp edges and corners of the clamping sheet. Since corresponding mold is used for contracting the clamping sheets, the corners will hurt the operator or damage the mold. The outer inclined surface can ensure the long-term use of the mold and the safety of the operator with a lower cost. A flat or a curved surface 3233 bulging outward is arranged between the two inclined surfaces to prevent formation of sharp edges and corners. A gradient of the outer inclined surface is higher than that of the inner inclined surface. Generally, the angle $\alpha$ between the outer inclined surface and the horizontal line is 60°, and the angle $\beta$ between the inner inclined surface and the horizontal line is 45°.

It is obvious that a plurality of fixing holes (not shown) can be defined on the fixing bracket to ensure the fixed connection between the fixing bracket and the condenser by means of screwing a nut bolt therein. It is simple in structure and convenient for disassembly.

The fixing bracket adopted by the disclosure has the following advantages:

1. The fixing bracket is connected to the condensing pipe directly, which can be used as a medium for absorbing or radiating heat and further increases the heat exchange area, that is, the fixing bracket directly performs heat exchange, and the heat exchange effect is higher than the previous method.

2. It is simple in structure, and convenient for production, lower in production cost, less in installation time, higher in the work efficiency.

3. It reduces the resonance frequency of the condenser, thereby reducing the vibration of the condenser and preventing loose in the connection with the refrigerator due to vibration, and avoiding unnecessary loss.

We claim:

1. A spiral finned condenser, comprising: a condensing pipe, a fin and a fixing bracket clamped and fixed on the condensing pipe; wherein the fin is spirally wound on a surface of the condensing pipe; the condensing pipe forms a structure by means of a plurality of turns and bends;

wherein the fixing bracket comprises a mounting plate and a clamping mechanism provided to a side wall of the mounting plate; the clamping mechanism consists of a plurality of clamping units distributed evenly on the mounting plate with regular intervals between neighboring clamping units; each clamping unit consists of two clamping sheets; a clamping slot is formed between the two clamping sheets; the clamping slot is configured to receive the condensing pipe;

wherein a bottom of the clamping slot is provided with a first adjusting groove, a second adjusting groove and a third adjusting groove; the first adjusting groove, the second adjusting groove and the third adjusting groove are extended downward in different directions; wherein the first adjusting groove, the second adjusting groove and the third adjusting groove are arranged spaced apart from one another; the second adjusting groove is located between the first adjusting groove and the third adjusting groove.

2. The spiral finned condenser according to claim 1, wherein an inner side of the fin having a cutout that forms a wavy portion is connected to the condensing pipe and an outer side of the fin is solid and does not contain a wavy cutout.

3. The spiral finned condenser according to claim 1, wherein an inner inclined surface is defined on an inner side of an end portion of the clamping sheets, an outer inclined surface is defined on an outer side of the end portion, and a flat or curved surface is arranged between the inner and outer inclined surfaces.

4. The spiral finned condenser according to claim 3, wherein a gradient of the outer inclined surface is higher than that of the inner inclined surface.

* * * * *